US006003462A

United States Patent [19]

Hystad

[11] Patent Number: 6,003,462

[45] Date of Patent: Dec. 21, 1999

[54] LOCKING MEMBER DEVICE FOR TOW PINS ON A VESSEL

[75] Inventor: Serina Hystad, Kopervik, Norway

[73] Assignee: Karmoy Winch A/S, Kopervik, Norway

[21] Appl. No.: 08/981,085

[22] PCT Filed: Jun. 12, 1996

[86] PCT No.: PCT/NO96/00143

§ 371 Date: Mar. 24, 1998

§ 102(e) Date: Mar. 24, 1998

[87] PCT Pub. No.: WO97/00195

PCT Pub. Date: Jan. 3, 1997

[30] Foreign Application Priority Data

Jun. 14, 1995 [NO] Norway ..... 952353

[51] Int. Cl.[6] ..... B63B 21/04

[52] U.S. Cl. ..... 114/253

[58] Field of Search ..... 114/253, 218, 114/199; 254/389, 393–396, 398, 403, 411, 413, 415

[56] References Cited

U.S. PATENT DOCUMENTS 4,603,649 8/1986 Hystad ..... 114/218

*Primary Examiner*—Ed Swinehart

*Attorney, Agent, or Firm*—Dorsey & Whitney LLP

[57] ABSTRACT

A device involving locking members (4, 5), so-called "flaps", for tow pins on a vessel, e.g., a tugboat, particularly for use with tow lines, towing wire, chains, or the like, where the tow pins are positioned in pairs at the stern of the vessel, optionally capable of being raised and lowered, for guiding the tow line or similar equipment therebetween, where each tow pin in a pair is provided to the top thereof with a respective projecting locking member (4, 5), and where each tow pin (1, 2) is pivotable to permit the locking members (4, 5) to be brought by rotation into locking position by covering the opening between the upper ends of the pins, thereby limiting the vertical movement of the tow line or similar equipment positioned between the tow pins. Each locking member (4, 5) in vertical section and in a transverse direction outward from its respective tow pin (1, 2) has approximately a U-shape. The locking member (4, 5) seen in horizontal plane describes a curve in such manner that said locking members when covering the opening between the tow pins together describe a curve (6) extending in the direction of the vessel stern, and that the U-shaped cross section of the locking member at the part (11) that faces toward the vessel stern has a gently curved form, while the part (12) facing away from the vessel stem has a more upwardly oriented and less pronounced curved form.

5 Claims, 3 Drawing Sheets

LOCKING MEMBER DEVICE FOR TOW PINS ON A VESSEL

RELATED APPLICATIONS

This application claims the priority of PCT Application No. PCT/NO96/00143, filed Jun. 12, 1996 and Norwegian Application No. 952353, filed Jun. 14, 1995, which are incorporated herein by reference.

SUMMARY OF THE INVENTION

The present invention relates to a device involving locking members, so-called "flaps," for tow pins on a vessel, e.g., a tugboat, particularly for use with tow lines, towing wire, chains, or the like, where the tow pins are positioned in pairs at the stern of the vessel, capable of being raised and lowered, for guiding the tow line or similar means therebetween, where each tow pin in a pair is provided at the top thereof with a respective projecting locking member, and where each tow pin during at least part of its vertical movement is pivotable to permit the locking members to be brought by rotation into locking position by covering the opening between the upper ends of the pins, thereby limiting the vertical movement of the tow line or similar means positioned between the tow pins.

To elucidate the prior art, reference is made to the invention described in Norwegian Patent No. 153527.

The known locking members or "flaps" in accordance with said Norwegian patent are primarily intended to serve as vertical stoppers and may under certain conditions prove less suitable in connection with towing, where the length of tow line, towing wire, chain or the like is to be adjusted, or where such towline or the like is oriented upwards.

The present invention thus aims to provide a solution for this in a simple but effective manner, and the device introduced above is thus characterized in that each locking member in vertical section and in a transverse direction outward from its respective tow pin has approximately a U-shape, that the locking member as seen in horizontal plane simultaneously describes a curve, and that the locking members at their respective exterior, free ends terminate in a straight wall part, these straight parts engaging with one another by means of respective male and female means thereon when the locking members together cover said opening between the tow pins.

In accordance with further embodiments of the device, it is considered advantageous that the locking member be cup-shaped, having said U cross section along their curved length, the deepest part of the cup being provided with mounting holes for the placement of fixing bolts for attachment to the tow pin.

Further, it is advantageous that the part of the locking members that faces downward toward the opening between the adjacent tow pins, when the members are brought together, should have in cross section, at least midway along said end wall part, the form of a shallow, inverted U, where the bottom of said U is approximately flat.

In still another embodiment of the device, said locking members when covering the opening between the tow pins will together describe a curve extending in the direction of the vessel stern, wherein the U-shaped cross section of the locking member where it faces toward the vessel stern has a gently curved form, while the part facing away from the vessel stern has a more upwardly oriented and less pronounced curved form.

BRIEF DESCRIPTION OF THE DRAWINGS

The invention will now be explained in more detail with reference to the attached drawings.

DETAILED DESCRIPTION OF THE PREFERRED EMBODIMENTS

Figure 1:
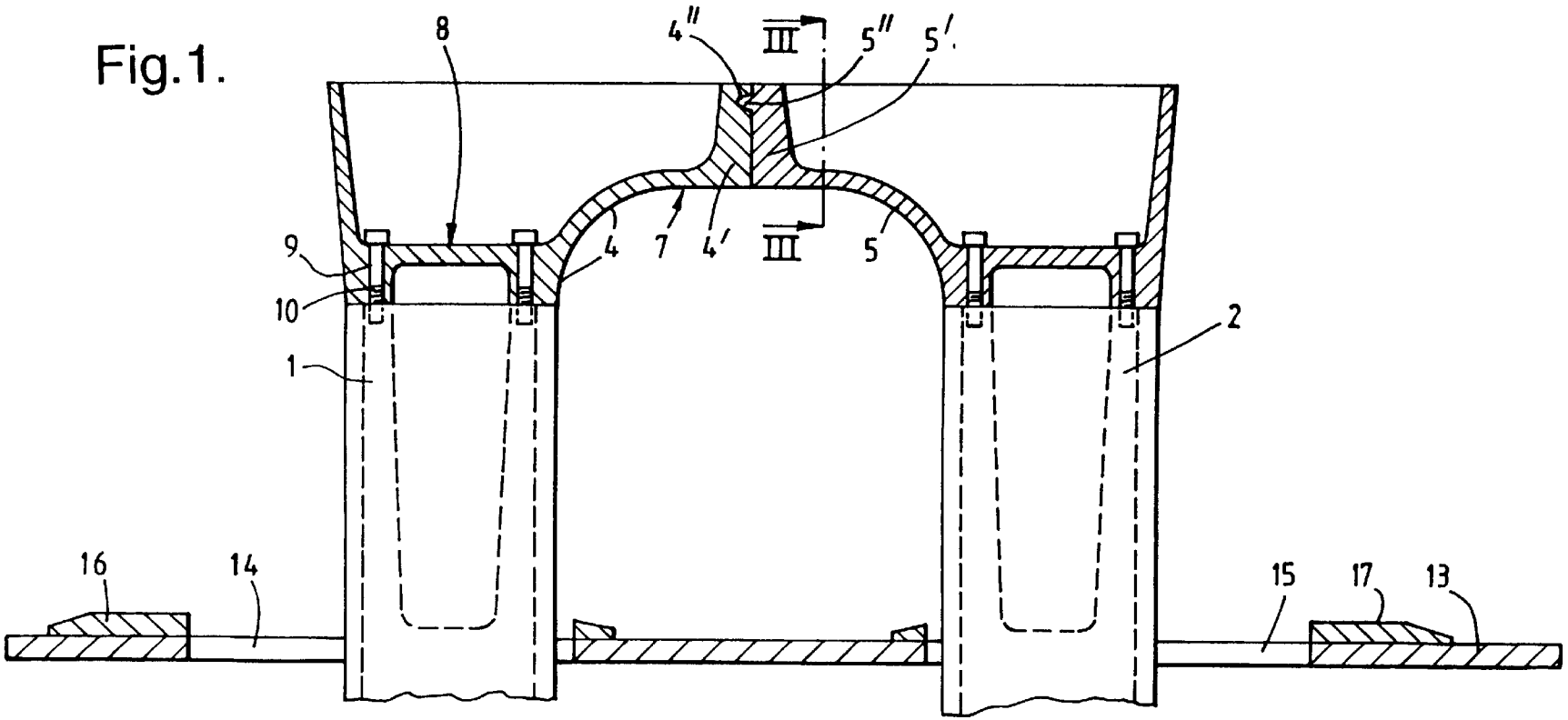
FIG. 1 shows the device according to the invention seen in cross section along the line I—I of FIG. 2.

As indicated by FIG. 1, a pair of tow pins 1, 2 is positioned preferably near the stern of a vessel (not shown on the drawings). As is apparent from the section along line III—III, depicted in more detail in FIG. 3, each locking member in vertical section and in a transverse direction outward from its respective tow pin has approximately a U-shape, indicated by reference numeral 3 on FIG. 3. As is also apparent from FIG. 2, the respective locking members 4 and 5 (seen in horizontal plane) describe a curve. This in turn means that when locking members 4 and 5 cover the opening between tow pins 1 and 2, as shown on FIGS. 1 and 2, the locking members will together describe a curve 6 extending in the direction of the vessel stern. Locking members 4 and 5 at their respective exterior, free ends terminate in a straight wall part 4', 5'. Wall part 4' is provided with a female means 4", and wall part 5' is provided with a male means 5", so that said male and female means on said wall parts will engage with one another when the locking members together cover the opening between the tow pins.

The part 7 of the locking members 4,5 that faces downward toward the opening between adjacent tow pins 1, 2, when the members are brought together, will have in cross section, at least midway along said end wall parts 4', 5', the form of a shallow, inverted U, with the center part of the U (near said wall parts 4', 5') being approximately flat.

Figure 3:
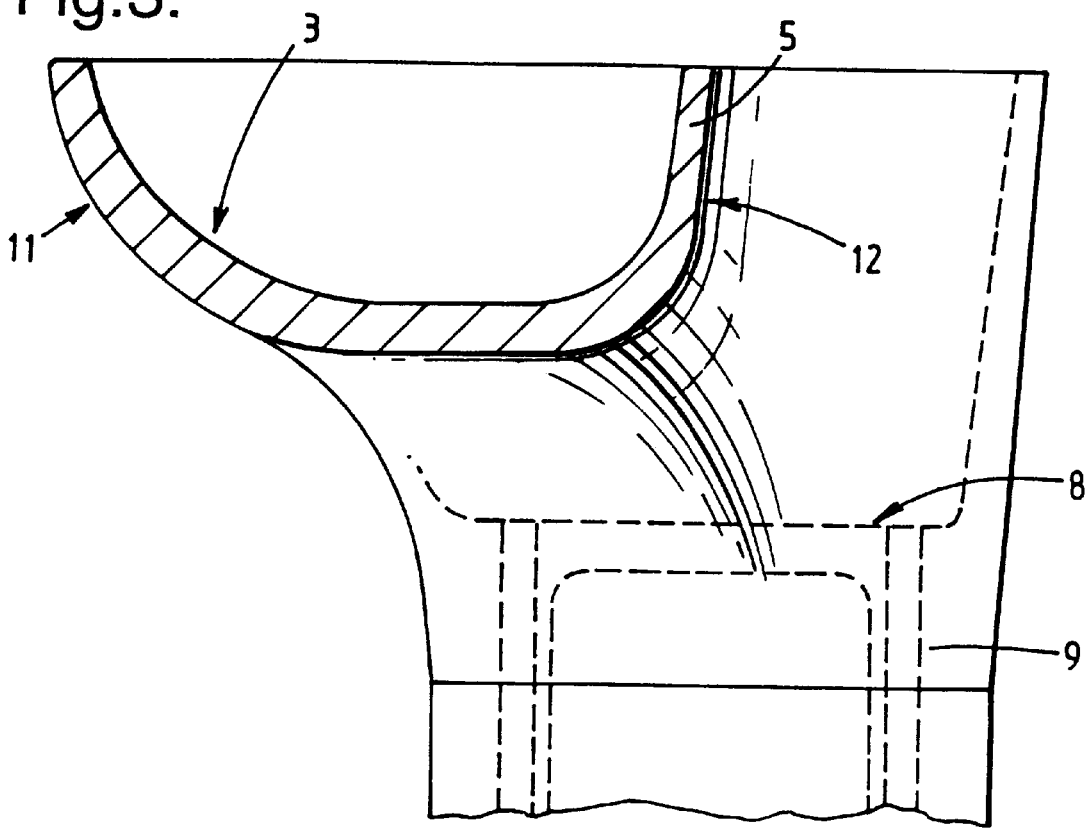
FIG. 3 shows the section along line III—III of FIG. 1.
Figure 4:
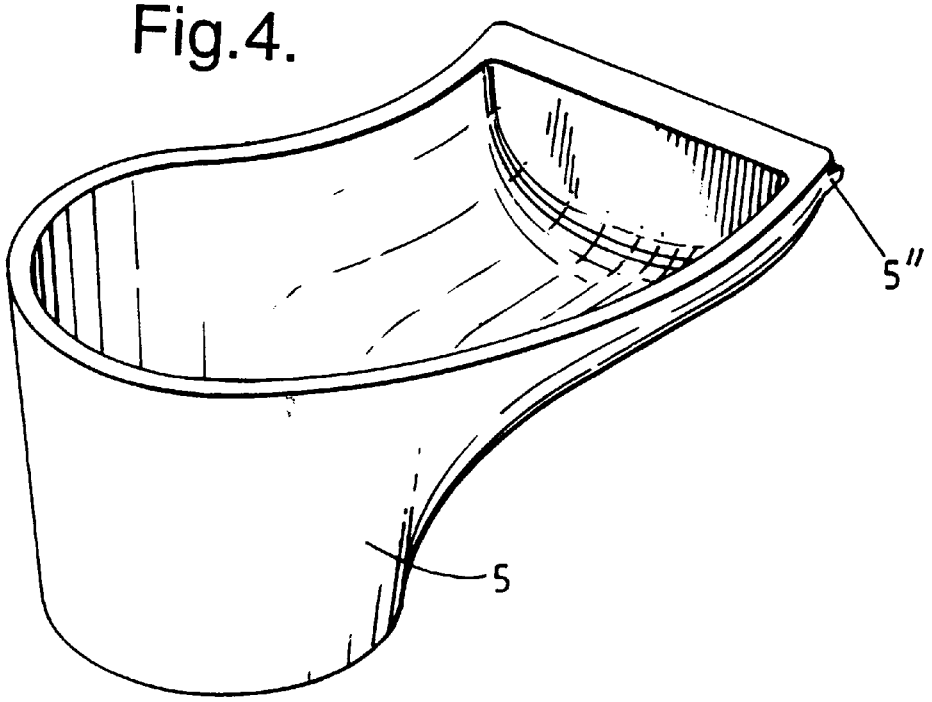
FIG. 4 is a perspective view of one of the locking members according to the invention.

As will be apparent from FIGS. 3 and 4, the locking member is preferably cup-shaped, having said U cross section along the curved length thereof. The deepest part 8 of said cup is provided with mounting holes 9 (see FIG. 1) for the placement of fixing bolts 10 for attachment to the respective tow pin.

The U-shaped cross section 3 of the part of the locking member that faces toward the vessel stern has a gently curved form, while part 12 facing away from the vessel stern has a more upwardly oriented and less pronounced curved form.

Figure 2:
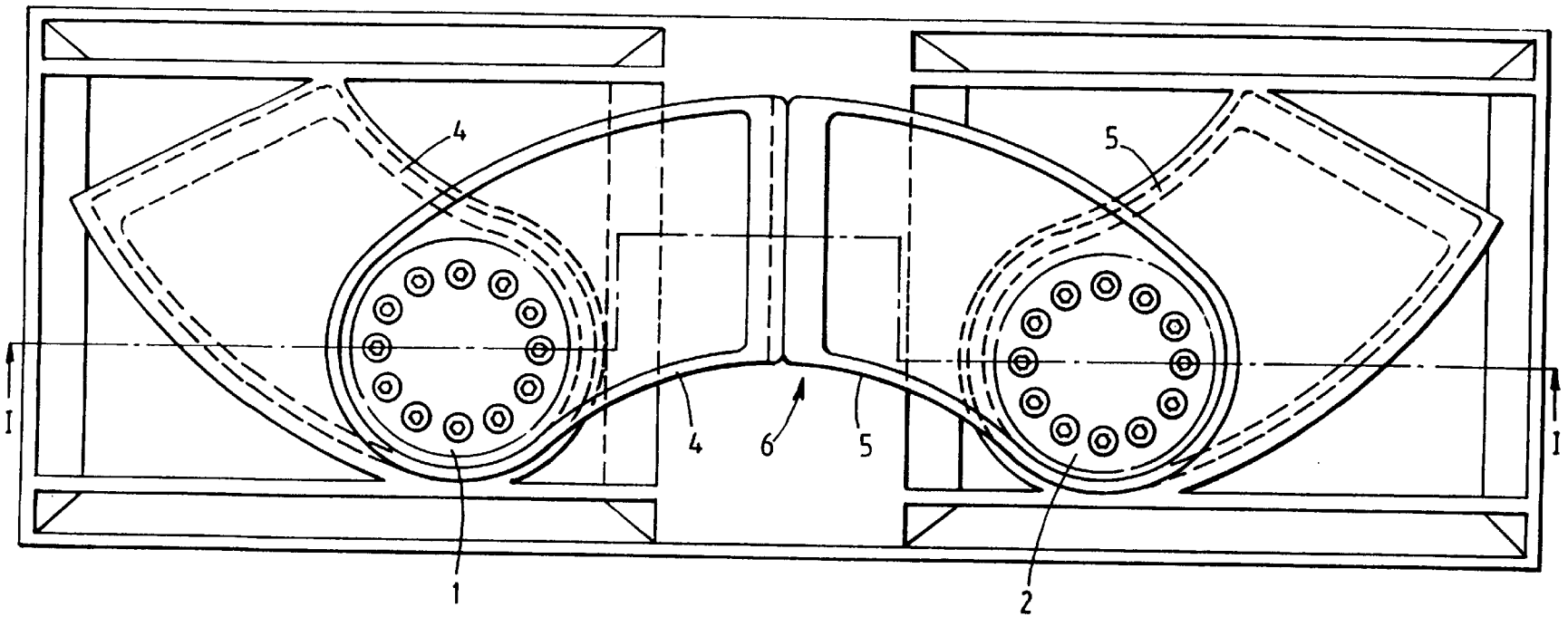
FIG. 2 shows a simplified plan drawing of the device according to the invention, where the locking members as drawn with solid lines are shown when turned toward one another, and with broken lines are shown when rotated apart.

As will be apparent from FIG. 2, locking members 4 and 5 are mounted for swinging movement outward to the side by means of tow pins 1 and 2 having been made correspondingly pivotable with respect to vessel deck 13. The locking members and tow pins may be raised and lowered as the tow pins simultaneously rotate during at least part of their vertical movement, e.g., in a manner technically equivalent to that shown in connection with Norwegian Patent No. 153527. This means, in a practical embodiment, that when locking members 4, 5, are rotated apart (as indicated with broken lines in FIG. 2) in their lowered position, their top surface is approximately in alignment with the vessel deck 13, and around the openings 14, 15 in the deck there are provided respective frames 16, 17, which build slightly up above the deck in height. When tow pins 1, 2 with their locking members 4, 5 are moved upward through the deck 13, a simultaneous rotation of tow pins 1, 2 will occur at the final stage of the vertical movement, causing locking members 4, 5 to rotate toward one another to cover the opening between tow pins 1, 2. An operation in the opposite sequence will occur when the tow pins and locking members are moved downwards.

The purely physical configuration of the locking members shown and described above is in no way considered limiting to the invention per se, as described in the patent claims, but is intended only to serve as an example with respect to a possible and, at the present time, preferred embodiment.

I claim:

1. A locking member pair in combination with a pair of vessel tow pins particulary for use with towing means such as tow lines, towing wire, towing rope or chains, where the tow pins are positioned in pairs at the stem of the vessel, and capable of being raised and lowered, for guiding the towing means therebetween, where each tow pin during a least part of vertical movement is pivotable to permit the locking member attached thereto to be rotated into locking position, the locking members thereby bridging an opening between upper ends of the pins, thereby limiting the vertical movement of the towing means positioned between the tow pins, characterized in that each locking member in vertical section and in a transverse direction outward from its respective tow pin has approximately a U-shape, that the locking member as seen in a horizontal plane simultaneously describes a curve, and said locking members having free ends terminating in straight wall parts having, respectively, male and female engaging means which engage when the locking members together bridge said opening between said tow pins.

2. The locking member pair as claimed in claim 1, characterized in that said locking members cup-shaped, having said U-shape cross section along the curved length thereof, the deepest part of the cup having mounting holes adapted to receive bolts for attachment to said tow pin.

3. The locking member pair as claimed in claim 1, characterized in that a part of the locking members which face downward toward the opening between the adjacent tow pins, when the members are brought together, will have a shallow, inverted U-shaped cross section, at least midway along said end wall part, wherein the bottom of said U-shaped cross section is approximately flat.

4. The locking member pair as claimed in claim 1, characterized in that said locking members, when bridging said opening between the tow pins installed on said vessel, curve in a direction toward the stern of said vessel, and said U-shaped cross section of said locking member, at the part curving in the direction toward the vessel stern has a gently curved form while the part facing in a direction opposite the stern of the vessel has a more upwardly oriented and less pronounced curved form.

5. The locking member pair as claimed in claim 2, characterized in that said locking members, when bridging said opening between the tow pins installed on said vessel, curve in a direction toward the stern of said vessel, and said U-shaped cross section of said locking member, at the part curving in the direction toward the vessel stern has a gently curved form while the part facing in a direction opposite the stern of the vessel has a more upwardly oriented and less pronounced curved form.

* * * * *

UNITED STATES PATENT AND TRADEMARK OFFICE

CERTIFICATE OF CORRECTION

PATENT NO. : 6,003,462

DATED : December 21, 1999

INVENTOR(S) : Per HYSTAD (deceased)

It is certified that error appears in the above-identified patent and that said Letters Patent are hereby corrected as shown below:

Title Page, item [75], please change "Serina Hystad" to read --Per Hystad (deceased)--;
In the Claims, column 3, line 14, please change "stem" to read --stern--; and,
In the Claims, column 3, line 32, after "members", please insert --are--.

Signed and Sealed this

First Day of May, 2001

*Attest:*

Nicholas P. Godici

NICHOLAS P. GODICI

*Attesting Officer*

*Acting Director of the United States Patent and Trademark Office*